US010611981B2

(12) United States Patent
Abraham et al.

(10) Patent No.: US 10,611,981 B2
(45) Date of Patent: Apr. 7, 2020

(54) MIXED PHOSPHORUS ESTERS FOR LUBRICANT APPLICATIONS

(71) Applicant: The Lubrizol Corporation, Wickliffe, OH (US)

(72) Inventors: William D. Abraham, Concord Township, OH (US); Nga H. Nguyen, Scotch Plains, NJ (US); Paul E. Adams, Willoughby, OH (US); Kurt F. Wollenberg, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 165 days.

(21) Appl. No.: 15/525,402

(22) PCT Filed: Nov. 5, 2015

(86) PCT No.: PCT/US2015/059153

§ 371 (c)(1),
(2) Date: May 9, 2017

(87) PCT Pub. No.: WO2016/077134

PCT Pub. Date: May 19, 2016

(65) Prior Publication Data

US 2018/0282654 A1 Oct. 4, 2018

Related U.S. Application Data

(60) Provisional application No. 62/078,622, filed on Nov. 12, 2014.

(51) Int. Cl.

| | |
|---|---|
| ***C10M 153/04*** | (2006.01) |
| ***C10M 159/12*** | (2006.01) |
| ***C10M 169/06*** | (2006.01) |
| ***C10M 117/04*** | (2006.01) |

(52) U.S. Cl.

CPC ..... *C10M 153/04* (2013.01); *C10M 117/04* (2013.01); *C10M 159/123* (2013.01); *C10M 169/06* (2013.01); *C10M 2207/1285* (2013.01); *C10M 2215/223* (2013.01); *C10M 2215/28* (2013.01); *C10M 2219/046* (2013.01); *C10M 2223/049* (2013.01); *C10M 2225/04* (2013.01); *C10N 2230/02* (2013.01); *C10N 2230/04* (2013.01); *C10N 2230/06* (2013.01); *C10N 2230/10* (2013.01); *C10N 2230/12* (2013.01); *C10N 2230/36* (2013.01); *C10N 2240/04* (2013.01); *C10N 2240/08* (2013.01); *C10N 2250/10* (2013.01)

(58) Field of Classification Search

CPC ..... C10N 2250/10; C10N 2230/02; C10N 2230/04; C10N 2230/06; C10N 2230/10; C10N 2230/12; C10N 2240/04; C10N 2240/08; C10M 2207/1285; C10M 2215/28; C10M 2215/223; C10M 2219/046; C10M 2223/049; C10M 2225/04

See application file for complete search history.

(56) References Cited

U.S. PATENT DOCUMENTS

| | | | | |
|---|---|---|---|---|
| 3,228,998 | A | 1/1966 | Fierce et al. | |
| 3,328,360 | A | 6/1967 | Rozanski et al. | |
| 4,298,481 | A | 11/1981 | Clarke | |
| 4,532,057 | A | 7/1985 | Horodysky et al. | |
| 4,549,976 | A | 10/1985 | Horodysky et al. | |
| 4,557,845 | A | 12/1985 | Horodysky et al. | |
| 4,704,218 | A | 11/1987 | Horodysky et al. | |
| 5,544,744 | A | 8/1996 | Oman | |
| 5,773,392 | A | 6/1998 | Romanelli et al. | |
| 6,103,673 | A | 8/2000 | Sumiejski et al. | |
| 6,730,640 | B2 | 5/2004 | Sowerby et al. | |
| 2009/0156448 | A1* | 6/2009 | Bera | C07C 229/18 508/368 |
| 2010/0063311 | A1 | 3/2010 | Mack et al. | |
| 2010/0197536 | A1 | 8/2010 | Mosier et al. | |
| 2013/0079264 | A1 | 3/2013 | Tipton et al. | |

FOREIGN PATENT DOCUMENTS

| | | | |
|---|---|---|---|
| GB | 1146379 | A1 | 3/1969 |
| WO | 2008/147704 | A1 | 12/2008 |

* cited by examiner

*Primary Examiner* — Vishal V Vasisth

(74) *Attorney, Agent, or Firm* — Michael Miller; David Shold; Teresan Gilbert

(57) ABSTRACT

A lubricant composition of an oil of lubricating viscosity and a phosphite ester reaction product of a monomeric phosphorous acid or an ester thereof with a first alkylene diol having two hydroxy groups in a 1,4 or 1,5 or 1,6 relationship and a second, alkyl-substituted, diol being a substituted 1,3-propylene diol, exhibits good wear and frictional performance.

27 Claims, No Drawings

MIXED PHOSPHORUS ESTERS FOR LUBRICANT APPLICATIONS

CROSS REFERENCE TO RELATED APPLICATION

This application claims priority from PCT Application Serial No. PCT/US2015/059153 filed on Nov. 5, 2015, which claims the benefit of U.S. Provisional Application No. 62/078,622 filed on Nov. 12, 2014, both of which are incorporated in their entirety by reference herein.

BACKGROUND OF THE INVENTION

The disclosed technology relates to phosphites which may be oligomeric or polymeric materials, and their use in lubricant formulations, including greases, hydraulic fluids, turbine oils, circulating oils, industrial gearbox lubricants, and other applications.

Phosphorus esters of various types are well known for their use as lubricant additives. For example, U.S. Publication 2013/0079264, Tipton et al., Mar. 28, 2013, discloses a polymeric phosphorus ester comprising the condensation product of a monomeric phosphorus acid or an ester thereof with a diol, wherein the two hydroxy groups of the diol are separated by a chain of 4 to about 100 carbon atoms. An appropriately small amount of diol material having 2 or 3 atoms separating the hydroxy groups may be employed, provided that it does not substantially interfere with the polymer formation. Examples are compared from 1,6-hexanediol, 1,4-butanediol, diethylene glycol, or triethylene glycol. The polymeric phosphorus ester contains at least three phosphorus-containing monomer units.

U.S. Pat. No. 6,730,640, Sowerby et al., May 4, 2004, discloses a method for lubricating a continuously variable transmission. The lubricant is a fluid composition which comprises an oil of lubricating viscosity and an oil-soluble zinc salt, which may be a zinc hydrocarbyl phosphate. The zinc hydrocarbyl phosphate can be prepared by reacting phosphorus acid or anhydride with an alcohol, followed by neutralization with a zinc base. The alcohols may be monohydric alcohols, or polyhydric alcohols such as alkylene polyols such as ethylene glycols, including di-, tri- and tetraethylene glycols; propylene glycols, including di-, tri- and tetrapropylene glycols; glycerol; and the like. Additional additives may also be present, such as other friction modifiers and phosphorus-containing antioxidants.

U.S. Pat. No. 4,557,845, Horodysky et al., Dec. 10, 1985, discloses products of reaction between a 2-hydroxyalkylalkylamine or certain higher oxylated members, and a dihydrocarbyl phosphite as friction reducers and fuel reducing additives for internal combustion engines when such products are compounded with lubricant and liquid fuels. Among the reaction products are compounds such as

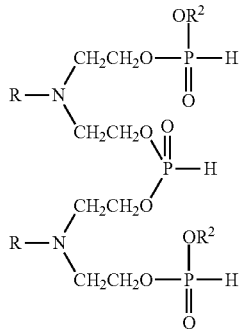

where R is a $C_6$ to $C_{30}$ hydrocarbyl group.

U.S. Pat. No. 5,773,392, Romanelli et al, Jun. 30, 1998, discloses an oil-soluble complex of an oil-insoluble phosphorus-containing acid and an alcohol. In certain examples, phosphorous acid is reacted with octylthioethanol and thiobisethanol. The complex is a useful antiwear additive.

U.S. Pat. No. 3,228,998, Fierce et al., Jan. 11, 1966, discloses liquid polyphosphate esters which may be useful as functional fluids. The general formula of the esters is

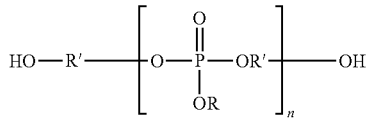

U.S. Pat. No. 3,328,360, Rozanski et al., Jun. 27, 1967, discloses polymers containing phosphorus, by reacting a mixture of direactive material and $P_4S_{10}$. Suitable direactive materials include, e.g., 1,10-decanediol. Derivatives of the phosphomers are generally useful as lubricant additives.

U.S. Pat. No. 5,544,744, Bloch et al., Aug. 22, 1995, discloses antiwear and antioxidant additives for use in lubricating oils. The additive is the reaction product of a phosphating agent and a thioalcohol. The alcohols may be represented by A-OH or OH—B—OH.

U.S. Pat. No. 4,549,976, Horodysky et al., Oct. 29, 1985, discloses lubricants and liquid fuel compositions containing a phosphorus oxyhalide vicinal diol reaction product. Examples show a phosphate ester of 1,2-mixed pentadecanediol-octadecanediol.

GB 1 146 379, Melle-Bezons, Mar. 26, 1969, discloses a transmission fluid using isopropylidene-bis[4-(nonylphenyl-decyl-phosphite)-cyclohexyl] as the antioxidant.

U.S. Pat. No. 4,298,481, Clarke, Nov. 3, 1981, discloses high temperature grease composition which contains a load bearing component. Useful load-bearing additives include polyphosphates including those of the structure $$(R_1O)(R_2O)P—OR_3O—[—O—P(OR_4)—OR_5O—]_n—P(OR_6)(OR_7)[sic]$$

$R_3$ and $R_5$ are polyalkylene glycol, alkylidene bisphenol, hydrogenated alkylidene bisphenol, or ring-halogenated alkylidene bisphenol from which the two terminal hydrogens have been removed; n is an integer in the range of 1 to 18.

U.S. Pat. No. 4,704,218, Horodysky et al., Nov. 3, 1987, discloses the reaction products of long chain vicinal diols containing at least 10 carbon atoms and one or more sulfur atoms in the chain, with a dihydrocarbyl hydrogen phosphate containing 1 to 6 carbon atoms in each hydrocarbyl group, as effective friction-reducing antiwear additives in lubricating oils, greases and fuels.

U.S. Pat. No. 6,103,673, Sumiejski et al., Aug. 15, 2000, discloses compositions containing friction modifiers for continuously variable transmissions, which include at least 0.1 percent by weight of at least one phosphorus compound. The phosphorus compound can be a phosphorus acid or ester of the formula $(R^1X)(R^2X)P(X)_nX_mR^3$ where $R^1$, $R^2$, and $R^3$ are hydrogen or hydrocarbyl groups. $R^1$ and $R^2$ groups can comprise a mixture of hydrocarbyl groups derived from commercial alcohols, examples being monohydric alcohols.

Mechanical devices such as industrial gearboxes and hydraulic fluid systems present highly challenging technological problems and solutions for satisfying the multiple and often conflicting lubricating and power transmitting requirements Low molecular weight phosphites such as dialkyl (e.g., dibutyl) phosphites (sometime referred to as dialkyl hydrogen phosphites), notwithstanding their known performance benefits when used in various lubricants, may exhibit certain problems. For instance, they may absorb into elastomeric seals, leading to degradation of the seal material. They may also interact with sulfur-containing materials within a lubricant to give rise to objectionable odor. Materials of the technology disclosed herein may provide one or more of improved anti-wear performance, reduced deposit formation, or improved seal compatibility, when used to lubricate a mechanical device.

SUMMARY OF THE INVENTION

The disclosed technology provides a lubricant composition comprising an oil of lubricating viscosity and a phosphite ester composition (e.g., other than a zinc salt), which comprises (A) the reaction product of (a) a monomeric phosphorous acid or an ester thereof with (b) at least two alkylene diols: a first alkylene diol (i) having two hydroxy groups in a 1,4 or 1,5 or 1,6 relationship; and a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 or 6 to 12; the relative molar amounts of monomeric phosphorous acid or ester thereof (a) and the total of the alkylene diols (b) being in a ratio of 0.9:1.1 to 1.1:0.9; and the relative molar amounts of the first alkylene diol (i) and the alkyl-substituted 1,3-propylene diol (ii) being in a ratio of 30:70 to 65:35.

In one embodiment the present invention provides a lubricant composition comprising an oil of lubricating viscosity and 0.001 wt % to 15 wt % of the disclosed phosphite ester.

In one embodiment the invention provides for the use of 0.001 wt % to 15 wt % of the disclosed phosphite ester in a lubricant and at least one of an antiwear agent, corrosion inhibitor (typically copper or iron corrosion). The phosphite ester disclosed herein may also be compatible with seals.

In one embodiment the invention provides a method of lubricating a hydraulic fluid system, comprising supplying to the hydraulic fluid system a lubricant disclosed herein.

In one embodiment the invention provides a method of lubricating a turbine system, comprising supplying to the turbine a lubricant disclosed herein. In one embodiment the invention provides a method of lubricating a circulating oil system, comprising supplying to the circulating oil system a lubricant disclosed herein. In one embodiment the invention provides a method of lubricating a mechanical device with a grease comprising supplying to the mechanical device a grease composition disclosed herein. In one embodiment the invention provides a method of lubricating an industrial gearbox comprising supplying to the industrial gearbox a lubricant composition disclosed herein.

In one embodiment the invention provides for the use of the phosphite ester disclosed herein as an antiwear agent, or a friction modifier in a hydraulic fluid system, a turbine system, a circulating oil system, an industrial gearbox, or a lubricating grease. (A hydraulic fluid system is generally a system or device in which a fluid, typically an oil-based fluid, transmits energy to different parts of the system by hydraulic force. A turbine lubricant is typically used to lubricate the gears or other moving parts of a turbine, such as a steam turbine or a gas turbine. A circulating oil is typically used to distribute heat to or through a device through which it is circulated and which may be lubricated therewith.)

As used herein, reference to the amounts of additives present in the lubricant composition disclosed are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

DETAILED DESCRIPTION OF THE INVENTION

Various preferred features and embodiments will be described below by way of non-limiting illustration.

Oils of Lubricating Viscosity

The lubricant composition of the present invention contains an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to

[0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the salt of the invention and the other performance additives.

The lubricant composition may be in the form of a concentrate and/or a fully formulated lubricant. If the lubricant composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Phosphorus-containing Compound

The formulations described herein will also contain a phosphite ester composition. The phosphite ester composition may be other than a zinc salt, that is it may be a composition that does not contain zinc, as in a zinc salt, for example. Alternatively, in some embodiments that phosphite ester composition may be zinc containing, or there may be a zinc-containing composition present in addition to the phosphite ester. An example of a zinc-containing composition is a zinc dialkyldithiophosphate. In certain embodiments, however, the lubricant composition may be free of or substantially free of zinc and/or zinc dialkyldithiophosphate. (As used herein, "substantially free" means that the amount of the material in question is less than an amount that will affect the relevant performance of the lubricant in a measurable way.)

The phosphite ester will comprise the reaction product, e.g., condensation product, of a monomeric phosphorous acid or an ester thereof with at least two alkylene diols. By "monomeric" phosphorous acid or ester is meant a phosphorous acid or ester, typically containing one phosphorus atom, which may be reacted with a diol in order to form an oligomeric, polymeric, or other condensed species. The monomeric phosphorous acid or ester thereof may be phosphorous acid itself ($H_3PO_3$), although a monomeric partial ester such as a dialkylphosphite may be used for ease of handling or other reasons. The alkyl group or groups may be relatively low molecular weight groups of 1 to 6 or 1 to 4 carbon atoms, such as methyl, ethyl, propyl, or butyl, such that the alcohol generated upon reaction with the alkylene diols may be easily removed. An exemplary phosphorous acid ester is dimethyl phosphite; others include diethyl phosphite, dipropyl phosphite, and dibutyl phosphite. Sulfur-containing analogues may also be employed (e.g., thiophosphites). Other esters include trialkyl phosphites. Mixtures of di- and trialkyl phosphites may also be useful. In these materials, the alkyl groups may be the same or different each independently typically having 1 to 6 or 1 to 4 carbon atoms as described above.

The phosphorus acid or ester will be reacted or condensed with at least two alkylene diols to form the material of the disclosed technology, which may include a polymeric (or oligomeric) phosphorus ester and optionally monomeric species. The first alkylene diol (i) will be a 1,4- or 1,5- or 1,6-alkylene diol. That is to say, there will be two hydroxy groups in a 1,4 or 1,5 or 1,6 relationship to each other, separated by a chain of 4, 5, or 6 carbon atoms, respectively. The first hydroxy group may be literally on the 1 carbon atom, that is, on the α carbon of the diol, or it may be on a higher numbered carbon atom. For example, the diol may also be a 2,5- or 2,6-, or 2,7-diol or a 3,6- or 3,7- or 3,8-diol, as will be evident to the skilled person. The alkylene diol may be branched (e.g., alkyl-substituted) or unbranched and in one embodiment is unbranched. Unbranched, that is, linear diols (α,ω-diols) include 1,4-butanediol, 1,5-pentane diol, and 1,6-hexanediol. Branched or substituted diols include 1,4-pentanediol, 2-methyl-1,5-pentanediol, 3-methyl-1,5-pentanediol, 3,3-dimethyl-1,5-pentanediol, 1,5-hexanediol, 2,5-hexanediol, and 2,5-dimethyl-2,5-hexanediol. For purposes of the disclosed technology, a diol having one or more secondary hydroxy groups (such as 2,5-hexanediol) may be referred to as a branched or substituted diol, even though the carbon chain itself may be linear. The location of the hydroxy groups in the 1,4-, 1,5-, or 1,6-positions (that is, either positions relative to each other or literal positions) may be helpful to promote oligomerization with the phosphorous species rather that formation of cyclic structures (which would be sterically disfavored). In certain embodiments the first alkylene diol may be 1,6-hexanediol.

The first alkylene dihydroxy compound (diol) may, if desired, have additional hydroxy groups, that is, more than two per molecule, or there may be exactly two. In one embodiment, there are exactly two hydroxy groups per molecule. If there are more than two hydroxy groups, care should be taken to assure that there is no excessive cyclization such as might interfere with the polymerization reaction, if there are fewer than 4 atoms separating any of the hydroxy groups. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

The phosphorous acid or ester is also reacted with a second alkylene diol (ii). The second alkylene diol is an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 to 12 or 6 to 12 or 7 to 11 or 8 to 18 or, in certain embodiments, 9. That is, the alkyl-substituted 1,3-propylene diol may be represented by the general formula

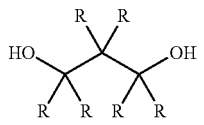

where the various R groups may be the same or different and may be hydrogen or an alkyl group, provided that at least 1 R is an alkyl group and that the total number of carbon atoms in the R groups is 2 to 9 or 3 to 9, so that the total carbon atoms in the diol will be 5 to 12 or 6 to 12, respectively, and likewise for the other ranges of total carbons. By analogy with the above-described, 1,4-, 1,5-, or 1,6-diols, reference here to 1,3-diols means that the two hydroxy groups are in a 1,3 relationship to each other, that is, separated by a chain of 3 carbon atoms. A 1,3-diol may thus also be named as a 2,4- or 3,5-diol. If the 1,3-diol has one or more secondary hydroxy groups, such a molecule will be considered to be a substituted diol. In one embodiment the number of alkyl substituents is 2 and the total number of carbon atoms in the molecule is 9. Suitable substituents may include, for instance, methyl, ethyl, propyl, and butyl (in their various possible isomers).

Examples of the second alkylene diol may include 2,2-dimethyl-1,3-propanediol, 2-ethyl-2-butylpropane-1,3-diol, 2-ethylhexane-1,3-diol, 2,2-dibutylpropane-1,3-diol, 2,2-diisobutylpropane-1,3-diol, 2-methyl-2-propylpropane-1,3-diol, 2-propyl-propane-1,3-diol, 2-butylpropane-1,3-diol, 2-pentylpropane-1,3-diol, 2-methyl-2-propylpropane-1,3-diol, 2,2-diethylpropane-1,3-diol, 2,2,4-trimethylpentane-1,3-diol, 2-methylpentane-2,4-diol, 2,4,-dimethyl-2,4-pentanediol, and 2,4-hexanediol. It should be noted that some of the foregoing nomenclature emphasizes the propane-1,3-diol structure of the molecules, for clarity. For instance, 2-pentylpropane-1,3-diol might also be named 2-hydroxymethylheptan-1-ol, but the latter nomenclature does not so clearly illustrate the 1,3-nature of the diol.

The relative molar amounts of the first alkylene diol (i) and the second alkylene diol (ii) may be in a ratio of 30:70 to 65:35, or alternatively 35:65 to 60:40 or 40:60 to 50:50 or 40:60 to 45:55. If the ratio is less than about 30:70, the resulting product may not fully exhibit the benefits of the disclosed technology, and if it is greater than about 65:35, its compatibility with other components in a lubricant formulation may be reduced.

The relative molar amounts of the monomeric phosphorous acid or ester thereof (a) and the total molar amounts of the alkylene diols (b) may be in a ratio of 0.9:1.1 to 1.1:0.9, or 0.95:1.05 to 1.05:0.95, or 0.98:1.02 to 1.02:0.98, or about 1:1. Reaction in approximately equimolar ratios will tend to encourage formation of oligomers or polymer formation. An exact 1:1 ratio could theoretically lead to extremely long chain formation and consequently very high molecular weight. In practice, however, this is not typically attained since competing reactions and incompleteness of reaction will provide materials of a lesser degree of polymerization, and a certain fraction of the material will be in the form of cyclic monomer.

The reaction product will typically comprise a mixture of individual species, including some oligomeric or polymeric species as well as cyclic monomeric species. The cyclic monomeric species may comprise 1 phosphorus atom and one alkylene group, derived principally from the 1,3-diol (ii), as the 1,3-diol is capable of either participation in oligomerization or cyclic ester formation. The oligomeric or polymeric species may typically comprise 3 to 20 phosphorus atoms, or alternatively 5 to 10 phosphorus atoms, linked together by alkylene groups derived from the diols (i) and (ii), and may exhibit a relative preference for incorporation of the 1,4-, 1,5-, or 1,6-diols, which are less readily able to cyclize with the phosphorus to form a cyclic monomeric species.

The product of the disclosed technology may be a mixture of species that may be represented by the structures shown:

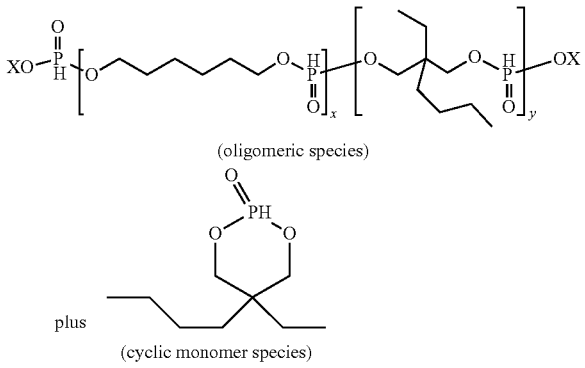

where x and y represent the relative amounts of the two diols incorporated into the oligomer. The structure shown is not intended to indicate that the polymer is necessarily a block polymer, since the structures represented by the x and y brackets may be more or less randomly distributed, as influenced by or depending on the availability of the various diol reactants. Each X is independently a terminating group, which may be, for instance, an alkyl group (such as methyl), or hydrogen or a diol-derived moiety which might terminate in an OH group. In the above scheme, for illustrative purposes only, the diene (i) is selected to be 1,6-hexanediol and diene (ii) is selected to be 2-butyl-2-ethyl-1,3-propanediol. Corresponding structures and mixtures would be formed using different diols (i) and (ii).

The relative amounts of oligomeric species and cyclic monomer species in the reaction mixture will depend, to some extent, on the specific diols selected and the reaction conditions. For reaction products prepared from 1,6-hexane diol and 2-butyl-2-ethyl-1,3-propanediol, as in the structures above, the amount of oligomeric product may be approximately as shown in the table below:

| mol % 1,6-diol | 30 | 40 | 50 | 60 | 65 |
|---|---|---|---|---|---|
| wt. % oligomer | 52 | 58 | 62 | 70 | 71 |

and the amount of the cyclic monomer may be 100% minus the percentage of the oligomer. It is also possible that, regardless of the specific diols employed, mixtures having the above weight percentages of oligomer and cyclic monomer may be usefully prepared. In certain embodiments, 55 to 60 percent of the product is in oligomeric form and 45 to 40 percent is in cyclic monomer form. In some embodiments the relative amount of the cyclic monomeric species to the amount of the oligomeric species is 1:3 to 1:1 or alternatively 1:3 to 1:0.8 by weight.

The condensation reaction between the phosphorus acid or ester and the diol may be accomplished by mixing the reagents and heating until the reaction is substantially complete. Typically the first and second alkylene diols may be mixed with the phosphorous compound at the same time or nearly the same time, that is, typically before the reaction with one of the alkylene diols is complete. A small amount of a basic material such as sodium methoxide may also be present. If a methyl ester of the phosphorous acid is used as a reagent, substantial completion of the reaction may correspond with the cessation of evolution and distillation of methanol from the reaction mixture. Suitable temperatures include those in the range of 100 to 140° C., such as 110 to 130° C. or 115 to 120° C. If reaction temperatures in excess of about 140° C. are employed, there is a risk that the desired product may not be formed in useful yields or with useful purity, since competing reactions may occur. Reaction times may typically be up to 12 hours, depending on temperature, applied pressure (if any), agitation, and other variables. In some instances reaction times of 2 to 8 hours or 4 to 6 hours may be appropriate.

Other monomers may be included within the reaction mixture if desired. In particular, the inclusion of a polycarboxylic acid, such as a dicarboxylic acid, is sometimes seen as beneficial. For example, inclusion of a relatively minor amount of tartaric acid or citric acid may provide products with useful properties. The amount of polyacid or diacid may an amount suitable to incorporate at least 1, or approximately 1, monomeric unit of poly- or dicarboxylic acid per product oligomer molecule. The amount of polyacid or diacid actually charged to the reaction mixture may be higher than this amount. Without intending to be bound by any theory, it is believed that when a minor amount of tartaric acid is present, it may be incorporated as an end unit of the polymer, possibly being condensed through an ester linkage with an OH group of an alkylene diol. Such materials may exhibit good performance in terms of antiwear protection and corrosion inhibition, as well as seals performance. Suitable polyacids (or their esters or anhydrides) include maleic acid, fumaric acid, tartaric acid, citric acid, phthalic acid, terephthalic acid, malonic acid (e.g., ester), succinic acid, malic acid, adipic acid, oxalic acid, sebacic acid, dodecanedioic acid, glutaric acid, and glutamic acid. Another type of monomer which may be included is a monocarboxylic acid which contains a reactive hydroxy group, or a reactive equivalent of such a material, such as an anhydride, ester, or lactone. Examples include glyoxylic acid, caprolactone, valerolactone, and hydroxystearic acid.

Other Performance Additives

A lubricant composition may be prepared by adding the phosphite ester disclosed herein to an oil of lubricating viscosity, optionally in the presence of other performance additives (as described hereinbelow).

The lubricant composition of the disclosed technology may further include other additives. In one embodiment the invention provides a lubricant composition further comprising at least one of a dispersant, an antiwear agent, a dispersant viscosity modifier, a friction modifier, a viscosity modifier, an antioxidant, an overbased detergent, a foam inhibitor, a demulsifier, a pour point depressant or mixtures thereof. In one embodiment the disclosed technology provides a lubricant composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates, phenates, and salicylates), or mixtures thereof.

Industrial Application

The amounts and specific lubricant compositions may vary with industrial application. For example, the phosphite ester may be useful in providing anti-wear performance in a lubricating grease, industrial gear or gearbox oil, turbine oil, hydraulic fluid, or circulating oil.

Lubricating Grease

In one embodiment the lubricant is a grease. The grease may have a composition comprising an oil of lubricating viscosity, a grease thickener, and an additive package 0.001 wt % to 15 wt %, or 0.01 wt % to 5 wt %, or 0.002 to 2 wt % of the above-described phosphite ester.

The grease thickening agent, or thickener, may include a metal salt of one or more carboxylic acids that is known in the art of grease formulation. Often the metal is an alkali metal, alkaline earth metal, aluminum, or mixtures thereof. Examples of suitable metals include lithium, potassium, sodium, calcium, magnesium, barium, titanium, aluminum, and mixtures thereof. The metal may include lithium, calcium, aluminum, or mixtures thereof (typically lithium).

The carboxylic acid used in the thickener is often a fatty acid and may include a mono-hydroxycarboxylic acid, a di-hydroxycarboxylic acid, a poly-hydroxycarboxylic acid or mixtures thereof. The carboxylic acid may have 4 to 30, 8 to 27, 19 to 24 or 10 to 20 carbon atoms and may include derivatives thereof such as esters, half esters, salts, anhydrides, or mixtures thereof. A particularly useful hydroxy-substituted fatty acid is hydroxystearic acid, wherein one or more hydroxy groups are often located at positions 10-, 11-, 12-, 13- or 14- on the alkyl group. Suitable examples may include 10-hydroxystearic acid, 11-hydroxystearic acid, 12-hydroxystearic acid, 13-hydroxystearic acid, 14-hydroxystearic acid and mixtures thereof. In one embodiment the hydroxy-substituted fatty acid is 12-hydroxystearic acid. Examples of other suitable fatty acids include capric acid, palmitic acid, stearic acid, oleic acid, behenic acid, and mixtures thereof.

In one embodiment the carboxylic acid thickener is supplemented with a dicarboxylic acid, a polycarboxylic acid, or mixtures thereof. Suitable examples include hexanedioic acid (adipic), iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid and mixtures thereof. The di-carboxylic acid and poly-carboxylic acid tend to be more expensive than mono-carboxylic acid and as a consequence, most industrial processes using mixtures typically use a molar ratio of dicarboxylic and/or polycarboxylic acid to monocarboxylic acid in the range 1:10 to 1:2, including 1:5, 1:4, 1:3, or 1:2 as possible values or upper or lower limits. The actual ratio of acids used depends on the desired properties of the grease for the actual application. In one embodiment the di-carboxylic acid thickener is nonanedioic acid (azelaic acid) and in another decanedioic acid (sebacic acid), or mixtures thereof.

The grease thickener may include simple metal soap grease thickeners, mixed alkali soaps, complex soaps, non-soap grease thickeners, metal salts of such acid-functionalized oils, polyurea and diurea grease thickeners, calcium sulfonate grease thickeners or mixtures thereof.

The greases thickener may also include or be used with other known polymer thickening agents such polytetrafluoroethylene (commonly known as PTFE), styrene-butadiene rubber, styrene-isoprene polymers, olefin polymers such as polyethylene or polypropylene or olefin co-polymers such as ethylene-propylene or mixtures thereof.

In one embodiment the thickener may also include or be used with other known thickening agents such as inorganic powders including clay, organo-clays, bentonite, montmorillonite, fumed and acid modified silicas, calcium carbonate as calcite, carbon black, pigments, copper phthalocyanine or mixtures thereof.

The grease may also be a sulfonate grease. Sulfonate greases are disclosed in more detail in U.S. Pat. No. 5,308,514. The calcium sulfonate grease may be prepared from overbasing the a neutral calcium sulfonate such that the calcium hydroxide is carbonated to form amorphous calcium carbonate and subsequently converted into either calcite, or vaterite or mixtures thereof, but typically calcite.

The grease thickener may be a urea derivative such as a polyurea or a diurea. Polyurea grease may include tri-urea, tetra-urea or higher homologues, or mixtures thereof. The urea derivatives may include urea-urethane compounds and the urethane compounds, diurea compounds, triurea compounds, tetraurea compounds, polyurea compounds, urea-urethane compounds, diurethane compounds and mixtures thereof. The urea derivative may for instance be a diurea compound such as, urea-urethane compounds, diurethane compounds or mixtures thereof. A more detailed description of urea compounds of this type is disclosed in U.S. Pat. No. 5,512,188 column 2, line 24 to column 23, line 36.

In one embodiment the grease thickener may be polyurea or diurea. The grease thickener may be a lithium soap or lithium complex thickener.

The amount of grease thickener present in the grease composition includes those in the range from 1 wt % to 50 wt %, or 1 wt % to 30 wt % of the grease composition.

The grease composition comprises an oil of lubricating viscosity as is described above. A grease composition may be prepared by adding a phosphite ester to an oil of lubricating viscosity, a grease thickener, optionally in the presence of other performance additives (as described herein below). The other performance additives may be present at 0 wt % to 10 wt %, or 0.01 wt % to 5 wt %, or 0.1 to 3 wt % of the grease composition.

The grease composition optionally comprises other performance additives. The other performance additives may include at least one of metal deactivators, viscosity modifiers, detergents, friction modifiers, antiwear agents, corrosion inhibitors, dispersants, dispersant viscosity modifiers, extreme pressure agents, antioxidants, and mixtures thereof. Each of these other performance additives is described herein.

In one embodiment the grease composition optionally further includes at least one other performance additive. The other performance additive compounds may include a metal deactivator, a detergent, a dispersant, an antiwear agent, an antioxidant, a corrosion inhibitor (typically a rust inhibitor), or mixtures thereof. Typically, a fully-formulated grease composition will contain one or more of these performance additives. The grease composition may contain a corrosion inhibitor or an antioxidant.

Antioxidants include diarylamine alkylated diarylamines, hindered phenols, dithiocarbamates, 1,2-dihydro-2,2,4-trimethylquinoline, hydroxyl thioethers, or mixtures thereof. In one embodiment the grease composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition.

The diarylamine alkylated diarylamine antioxidant may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. The bridging atom may be carbon or sulfur. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

The dithiocarbamate anti-oxidant may be metal containing such as molybdenum or zinc dithiocarbamate or it may be "ashless," referring to the dithiocarbamate as containing no metal.

The 1,2-dihydro-2,2,4-trimethylquinoline antioxidant may be present as a unique molecule or oligomerized with up to 5 repeat units and known commercially as "Resin D", available from a number of suppliers.

In one embodiment the grease composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

Some polymers may also be described as dispersant viscosity modifiers (often referred to as DVM) because they exhibit dispersant properties. Polymers of this type include olefins, for example, ethylene propylene copolymers that have been functionalized by reaction with maleic anhydride and an amine. Another type of polymer that may be used is polymethacrylate functionalized with an amine (this type may also be made by incorporating a nitrogen containing co-monomer in a methacrylate polymerization). More detailed description of dispersant viscosity modifiers are disclosed in International Publication WO2006/015130 or U.S. Pat. Nos. 4,863,623; 6,107,257; 6,107,258; and 6,117,825.

The viscosity modifiers may be present at 0 wt % to 15 wt %, or 0 wt % to 10 wt %, or 0.05 wt % to 5 wt %, or 0.2 wt % to 2 wt % of the grease composition.

The grease composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

In one embodiment the invention provides a grease composition further comprising a metal-containing detergent, which may be overbased or neutral. The metal-containing detergent may be a calcium or magnesium detergent.

The metal-containing detergent may be chosen from non-sulfur containing phenates, sulfur containing phenates, sulfonates, salixarates, salicylates, and mixtures thereof, or borated equivalents thereof. The detergent may be borated with a borating agent such as boric acid such as a borated overbased calcium or magnesium sulfonate detergent, or mixtures thereof. The metal-containing detergent may also be an overbased detergent with total base number ranges from 30 to 500 mg KOH/g Equivalents (TBN as per ASTM D4739).

The detergent may be present at 0 wt % to 6 wt %, or 0.01 wt % to 4 wt %, or 0.05 wt % to 2 wt %, or 0.1 wt % to 2 wt % of the grease composition, or alternatively 0 wt % to 2 wt %, or 0.05 wt % to 1.5 wt %, or 0.1 wt % to 1 wt % of the grease composition.

In one embodiment the grease disclosed herein may contain at least one additional friction modifier other than the phosphite of the disclosed technology, described above. The additional friction modifier may be present at 0 wt % to 6 wt %, or 0.01 wt % to 4 wt %, or 0.05 wt % to 2 wt %, or 0.1 wt % to 2 wt % of the grease composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea, and salts thereof.

Friction modifiers may also encompass materials such as sulfurized fatty compounds and olefins, sulfurized molybdenum dialkyldithiophosphates, sulfurized molybdenum dithiocarbamates, or other oil soluble molybdenum complexes such as Molyvan® 855 (commercially available from R.T. Vanderbilt, Inc) or Sakuralube® S-700 or Sakuralube® S-710 (commercially available from Adeka, Inc). The oil soluble molybdenum complexes assist in lowering the friction, but may compromise seal compatibility.

In one embodiment the friction modifier may be an oil soluble molybdenum complex. The oil soluble molybdenum complex may include sulfurized molybdenum dithiocarbamate, sulfurized molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of Luvodor® MB or Luvador® MBO (commercially available from Lehmann and Voss GmbH), The oil soluble molybdenum complexes may be present at 0 wt % to 5 wt %, or 0.1 wt % to 5 wt % or 1 to 3 wt % of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The grease composition optionally further includes at least one antiwear agent (other than the phosphite disclosed in detail above). Examples of suitable antiwear agents include titanium compounds, oil soluble amine salts of phosphorus compounds, sulfurised olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulfides, and oil soluble phosphorus amine salts. In one embodiment the grease composition may further include metal dihydrocarbyldithiophosphates (such as zinc dialkyldithiophosphates). The optional anti-wear may be present at 0 wt % to 5 wt %, or 0.1 wt % to 5 wt % or 1 to 3 wt % of the grease composition.

The grease composition optionally also contains an extreme pressure agent, which may be a compound containing sulfur and/or phosphorus. Examples of an extreme pressure agents include a polysulfide, a sulfurized olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]- thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulfide molecules are a mixture of tri- or tetra-sulfides. In other embodiments at least 55 wt %, or at least 60 wt % of the polysulfide molecules are a mixture of tri- or tetra-sulfides.

The polysulfide may include a sulfurised organic polysulfide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides and synthetic sperm whale oil.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene or mixtures thereof. In one embodiment the polysulfide comprises a polyolefin derived from polymerizing by known techniques an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present at 0 wt % to 5 wt %, 0.01 wt % to 4 wt %, 0.01 wt % to 3.5 wt %, 0.05 wt % to 3 wt %, and 0.1 wt % to 1.5 wt %, or 0.2 wt % to 1 wt % of the grease composition.

Solid additives in a particle or finely divided form may also be used in a grease at levels of 0% to 20% by weight. These include graphite, molybdenum disulfide, zinc oxide, boron nitride, or polytetrafluoroethylene. Mixtures of solid additives may also be used.

The grease composition may also contain a metal deactivator, which may comprise one or more derivatives of benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercaptothiadiazoles or mixtures thereof. The metal deactivator may also be described as corrosion inhibitors.

The benzotriazole compounds may include hydrocarbyl substitutions at one or more of the following ring positions 1- or 2- or 4- or 5- or 6- or 7-benzotriazoles. The hydrocarbyl groups may contain from 1 to 30 carbons, and in one embodiment from 1 to 15 carbons, and in one embodiment from 1 to 7 carbons. The metal deactivator may comprise 5-methylbenzotriazole.

Another optional component is a metal deactivator, which may be present in the grease composition at a concentration in the range up to 5 wt %, or 0.0002 to 2 wt %, or 0.001 to 1 wt %.

The rust inhibitor may comprise one or more metal sulfonates such as calcium sulfonate or magnesium sulfonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from 8 to 24 carbon atoms with alcohols such as polyglycols.

The rust inhibitors may present in the grease composition at a concentration in the range up to 4 wt %, and in one embodiment in the range from 0.02 wt % to 2 wt %, and in one embodiment in the range from 0.05 wt % to 1 wt %.

The grease composition may comprise:

0.001 wt % to 10 wt % of a a phosphite ester as described herein;

1 wt % to 20 wt % of a grease thickener;

0 wt % to 5 wt % of an extreme pressure agent;

0 wt % to 10 wt % of other performance additives; and balance of an oil of lubricating viscosity.

The grease composition may comprise 0.002 wt % to 5.0 wt % of a phosphite ester as described herein;

1 wt % to 20 wt % of a grease thickener;

0.2 wt % to 1 wt % of an extreme pressure agent;

0.1 wt % to 10 wt % of other performance additives; and balance of an oil of lubricating viscosity.

The grease composition may also be:

Grease Additive Package Compositions*

| | Embodiments (wt %) | |
|---|---|---|
| Additive | Multi-functional | High Temp-Long Life |
| Phosphite Ester of the invention | 20-30 | 0.1 to 5.0 |
| Antioxidant | 10 to 20 | 25.0-60.0 |
| Dispersant | 0.50 to 5.0 | — |
| Metal Deactivator | 1.0 to 8.0 | — |
| Antiwear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

In order to demonstrate improved performance in a grease composition, the composition may be evaluated versus control standards as to ASTM D4172-94(2010): Standard Test Method for Wear Preventive Characteristics of Lubricating Fluid (Four-Ball Method), ASTM D4170-10: Standard Test Method for Fretting Wear Protection by Lubricating Greases, ASTM D5969-11e: Standard Test Method for Corrosion-Preventive Properties of Lubricating Greases in Presence of Dilute Synthetic Sea Water Environments and ASTM D6138-13: Standard Test Method for Determination of Corrosion-Preventive Properties of Lubricating Greases Under Dynamic Wet Conditions (Emcor Test).

Hydraulic Fluid, Turbine Oil or Circulating Oil

In one embodiment the lubricant composition contains 0.001 wt % to 5 wt % of the above-described phosphite ester, or 0.002 wt % to 3 wt %, or 0.005 to 1 wt %.

The lubricant compositions may also contain one or more additional additives. In some embodiments the additional additives may include an antioxidant, an antiwear agent, a corrosion inhibitor, a rust inhibitor, a foam inhibitor, a dispersant, a demulsifier, a metal deactivator, a friction modifier, a detergent, an emulsifier, an extreme pressure agent, a pour point depressant, a viscosity modifier, or any combination thereof.

The lubricant may thus comprise an antioxidant, or mixtures thereof. The antioxidant may be present at 0 wt % to 4.0 wt %, or 0.02 wt % to 3.0 wt %, or 0.03 wt % to 1.5 wt % of the lubricant.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines. In one embodiment, the diphenylamine is alkylated with a benzene and t-butyl substituent.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidants, include commercial materials sold under the trade names such as Molyvan 822®, Molyvan® A, Molyvan® 855 and from R. T. Vanderbilt Co., Ltd., and Adeka Sakura-Lube™ S-100, S-165, S-600 and 525, or mixtures thereof. An example of a dithiocarbamate which may be used as an antioxidant or antiwear agent is Vanlube® 7723 from R. T. Vanderbilt Co., Ltd.

The antioxidant may include a substituted hydrocarbyl mono-sulfide represented by the formula:

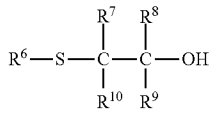

wherein $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

The lubricant compositions may also include a dispersant or mixtures thereof. Suitable dispersants include: (i) polyetheramines; (ii) borated succinimide dispersants; (iii) non-borated succinimide dispersants; (iv) Mannich reaction products of a dialkylamine, an aldehyde and a hydrocarbyl substituted phenol; or any combination thereof. In some embodiments the dispersant may be present at 0 wt % to 1.5 wt 5, or 0.01 wt % to 1 wt %, or 0.05 to 0.5 wt % of the overall composition.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729.

Antifoam agents, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the antifoam is a polyacrylate. Anti-foams may be present in the composition from 0.001 wt % to 0.012 wt % or 0.004 wt % or even 0.001 wt % to 0.003 wt %.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. Demulsifiers may be present in the composition from 0.002 wt % to 0.012 wt %.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant compositions may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

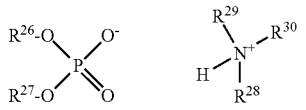

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a $C_{14}$ to $C_{18}$ alkylated phosphoric acid with Primene 81R (produced and sold by Rohm & Haas) which is a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid. An example of a suitable ester of a nitrogen-containing carboxylic acid includes oleyl sarcosine.

The rust inhibitors may be present in the range from 0.02 wt % to 0.2 wt %, from 0.03 wt % to 0.15 wt %, from 0.04 wt % to 0.12 wt %, or from 0.05 wt % to 0.1 wt % of the lubricating oil composition. The rust inhibitors may be used alone or in mixtures thereof.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors.

The metal deactivators may be present in the range from 0.001 wt % to 0.1 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

In one embodiment the invention provides a lubricant composition further comprises a metal-containing detergent. The metal-containing detergent may be a calcium or magnesium detergent. The metal-containing detergent may also be an overbased detergent with total base number ranges from 30 to 500 mg KOH/g Equivalents.

The metal-containing detergent may be chosen from non-sulfur containing phenates, sulfur containing phenates, sulfonates, salixarates, salicylates, and mixtures thereof, or borated equivalents thereof. The metal-containing detergent may be may be chosen from non-sulfur containing phenates, sulfur containing phenates, sulfonates, and mixtures thereof. The detergent may be borated with a borating agent such as boric acid such as a borated overbased calcium or magnesium sulfonate detergent, or mixtures thereof. The detergent may be present at 0 wt % to 5 wt %, or 0.001 wt % to 1.5 wt %, or 0.005 wt % to 1 wt %, or 0.01 wt % to 0.5 wt % of the hydraulic fluid composition.

The extreme pressure agent may be a compound containing sulfur and/or phosphorus. Examples of extreme pressure agents include polysulfides, sulfurized olefins, thiadiazoles, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

The polysulfide may include a sulfurized organic polysulfide from oils, fatty acids or esters, olefins, or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurised olefin includes an olefin derived from propylene, isobutylene, pentene or mixtures thereof. In one embodiment the polysulfide comprises a polyolefin derived from polymerising by known techniques an olefin as described above. In one embodiment the polysulfide includes dibutyl tetrasulfide, sulfurised methyl ester of oleic acid, sulfurised alkylphenol, sulfurised dipentene, sulfurised dicyclopentadiene, sulfurised terpene, and sulfurised Diels-Alder adducts.

The extreme pressure agent may be present at 0 wt % to 3 wt %, 0.005 wt % to 2 wt %, 0.01 wt % to 1.0 wt % of the hydraulic fluid composition.

The lubricant may further comprise a viscosity modifier, or mixtures thereof. Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth)acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth) acrylic acid ester, an olefin copolymer or mixtures thereof. The viscosity modifiers may be present at 0 wt % to 10 wt %, 0.5 wt % to 8 wt %, 1 wt % to 6 wt % of the lubricant.

In one embodiment the lubricant disclosed herein may contain at least one additional friction modifier other than the phosphite ester disclosed herein. The additional friction modifier may be present at 0 wt % to 3 wt %, or 0.02 wt % to 2 wt %, or 0.05 wt % to 1 wt %, of the hydraulic fluid composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

In one embodiment the lubricant composition further includes an additional antiwear agent. Typically the additional antiwear agent may be a phosphorus antiwear agent (other than the salt of the present invention), or mixtures thereof. The additional antiwear agent may be present at 0 wt % to 5 wt %, 0.001 wt % to 2 wt %, 0.1 wt % to 1.0 wt % of the lubricant.

The phosphorus antiwear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulfur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof. Mixtures of amines may also be used. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulfur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents, and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

In one embodiment the antiwear additives may include a zinc dialkyldithiophosphate, In other embodiments the compositions of the present invention are substantially free of, or even completely free of zinc dialkyldithiophosphate.

In one embodiment the invention provides for a composition that includes a dithiocarbamate antiwear agent defined in U.S. Pat. No. 4,758,362 column 2, line 35 to column 6, line 11. When present the dithiocarbamate antiwear agent may be present from 0.25 wt %, 0.3 wt %, 0.4 wt % or even 0.5 wt % up to 0.75 wt %, 0.7 wt %, 0.6 wt % or even 0.55 wt % in the overall composition.

A hydraulic lubricant may thus comprise:

0.01 wt % to 3 wt % of the phosphite ester disclosed herein, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral of slightly overbased calcium naphthalene sulfonate (typically a neutral or slightly overbased calcium dinonyl naphthalene sulfonate), and 0.001 wt % to 2 wt %, or 0.01 wt % to 1 wt % of an antiwear agent (other than the phosphite ester of the present invention) chosen from zinc dialkyldithiophosphate, zinc dialkylphosphate, amine salt of a phosphorus acid or ester, or mixtures thereof.

A hydraulic fluid may also comprise a formulation defined in the following table:

Hydraulic Fluid compositions

| | Embodiments (wt %) | | |
|---|---|---|---|
| Additive | A | B | C |
| Phosphite Ester of the invention | 0.001 to 5.0 | 0.005 to 3.0 | 0.01 to 1.0 |
| Antioxidant | 0 to 4.0 | 0.02 to 3.0 | 0.03 to 1.5 |
| Dispersant | 0 to 2.0 | 0.005 to 1.5 | 0.01 to 1.0 |
| Detergent | 0 to 5.0 | 0.001 to 1.5 | 0.005 to 1.0 |
| Antiwear Agent | 0 to 5.0 | 0.001 to 2 | 0.1 to 1.0 |
| Friction Modifier | 0 to 3.0 | 0.02 to 2 | 0.05 to 1.0 |
| Viscosity Modifier | 0 to 10.0 | 0.5 to 8.0 | 1.0 to 6.0 |
| Any Other Performance Additive (antifoam/demulsifier/pour point depressant) | 0 to 1.3 | 0.00075 to 0.5 | 0.001 to 0.4 |
| Metal Deactivator | 0 to 0.1 | 0.01 to 0.04 | 0.015 to 0.03 |
| Rust Inhibitor | 0 to 0.2 | 0.03 to 0.15 | 0.04 to 0.12 |
| Extreme Pressure Agent | 0 to 3.0 | 0.005 to 2 | 0.01 to 1.0 |
| Oil of Lubricating Viscosity | Balance to 100% | Balance to 100% | Balance to 100% |

Specific examples of a hydraulic fluid include those summarized in the following table:

Hydraulic Fluid compositions

| | Embodiments (wt %) | | |
|---|---|---|---|
| Additive | A | B | C |
| Phosphite Ester of the invention | 0 | 0.25 | 0.5 |
| Antioxidant- aminic/phenolic | 0.4 | 0.4 | 0.4 |
| Calcium Sulfonate Detergent | 0.2 | 0.2 | 0.2 |
| Zinc dialkyl dithiophosphate | 0.3 | 0.15 | 0 |
| Any Other Performance Additive (antifoam/demulsifier/pour point depressant) | 0.01 | 0.01 | 0.01 |
| Triazole Metal Deactivator | 0.005 | 0.005 | 0.005 |
| Oil of Lubricating Viscosity | Balance to 100% | Balance to 100% | Balance to 100% |

Antiwear performance of each lubricant may be evaluated in accordance with ASTM D6973-08e1 Standard Test Method for Indicating Wear Characteristics of Petroleum Hydraulic Fluids in a High Pressure Constant Volume Vane Pump. Antiwear performance may also be evaluated utilizing a standard Falex Block-on-Ring wear and friction test machine. In this test, a standard test block is modified to accept a piece of actual 35VQ pump vain. The vane is in contact with a standard Falex ring in which a load is applied to the fixed vane and the ring rotates. The screen test runs at a similar load, sliding speed and oil temperature conditions as seen in standard 35VQ pump test. The mass of the test vane and ring are measured before and after the test. Performance is judge by the total amount of mass loss measured.

Industrial Gearboxes

The lubricants of the disclosed technology may include an industrial additive package, which may also be referred to as an industrial lubricant additive package or an industrial gearbox lubricant additive package. In other words, the lubricants are designed to be industrial lubricants, or additive packages for making the same. Such lubricants do not necessarily relate to automotive gear lubricants or other lubricant compositions.

In some embodiments the industrial lubricant additive package includes a demulsifier, a dispersant, and a metal deactivator. Any combination of conventional additive packages designed for industrial application may be used.

The additives which may be present in the industrial additive package include a foam inhibitor, a demulsifier, a pour point depressant, an antioxidant, a dispersant, a metal deactivator (such as a copper deactivator), an antiwear agent, an extreme pressure agent, a viscosity modifier, or some mixture thereof. The additives may each be present in the range from 50 ppm, 75 ppm, 100 ppm or even 150 ppm up to 5 wt %, 4 wt %, 3 wt %, 2 wt % or even 1.5 wt %, or from 75 ppm to 0.5 wt %, from 100 ppm to 0.4 wt %, or from 150 ppm to 0.3 wt %, where the wt % values are with regards to the overall lubricant composition. In other embodiments the overall industrial additive package may be present from 1 to 20, or from 1 to 10 wt % of the overall lubricant composition. However it is noted that some additives, including viscosity modifying polymers, which may alternatively be considered as part of the base fluid, may be present in higher amounts including up to 30 wt %, 40 wt %, or even 50 wt % when considered separate from the base fluid. The additives may be used alone or as mixtures thereof.

The lubricant may include antifoam agent. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the antifoam agent may be a polyacrylate. Antifoam agents may be present in the composition from 0.001 wt % to 0.012 wt % or 0.004 wt % or even 0.001 wt % to 0.003 wt %.

The lubricant may also include demulsifier. The demulsifier may include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of a demulsifier include polyethylene glycols, polyethylene oxides, polypropylene oxides, (ethylene oxide-propylene oxide) polymers and mixtures thereof. The demulsifier may be a polyether. The demulsifier may be present in the composition from 0.002 wt % to 0.2 wt %.

The lubricant may include a pour point depressant. The pour point depressant may include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, or any combination thereof; or mixtures thereof.

Suitable hydrocarbyl amine salts of alkylphosphoric acid may be represented by the following formula:

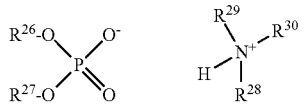

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid may be the reaction product of a $C_{14}$ to $C_{18}$ alkylated phosphoric acid with Primene 81R (produced and sold by Rohm & Haas) which may be a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid. An example of a suitable ester of a nitrogen-containing carboxylic acid includes oleyl sarcosine.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors. The metal deactivators may be present in the range from 0.001 wt % to 0.5 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

The lubricants may also include antioxidant, or mixtures thereof. The antioxidants, including (i) an alkylated diphenylamine, and (ii) a substituted hydrocarbyl mono-sulfide. In some embodiments the alkylated diphenylamines include bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide may be 1-(tert-dodecylthio)-2-propanol. The antioxidant package may also include sterically hindered phenols. Examples of suitable hydrocarbyl groups for the sterically hindered phenols include 2-ethylhexyl or n-butyl ester, dodecyl or mixtures thereof. Examples of methylene-bridged sterically hindered phenols include 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The antioxidants may be present in the composition from 0.01 wt % to 6.0 wt % or from 0.02 wt % to 1 wt %. The additive may be present in the composition at 1 wt %, 0.5 wt %, or less.

The lubricant may also include nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

The lubricant may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples the sulfur-containing compound is a sulfurized olefin derived from any of the natural oils or synthetic oils described above, or even some combination thereof. For example the sulfurized olefin may be derived from vegetable oil. The sulfurized olefin may be present in the lubricant composition from 0 wt % to 5.0 wt % or from 0.01 wt % to 4.0 wt % or from 0.1 wt % to 3.0 wt %.

The lubricant may also include phosphorus containing compound, such as a fatty phosphite, in addition to the phosphite ester disclosed herein. The phosphorus containing compound may include a hydrocarbyl phosphite, a phosphoric acid ester, an amine salt of a phosphoric acid ester, or any combination thereof. In some embodiments the phosphorus containing compound includes a hydrocarbyl phosphite, an ester thereof, or a combination thereof. In some embodiments the phosphorus containing compound includes a hydrocarbyl phosphite. In some embodiments the hydrocarbyl phosphite may be an alkyl phosphite. By alkyl it is meant an alkyl group containing only carbon and hydrogen atoms, however either saturated or unsaturated alkyl groups are contemplated or mixtures thereof. In some embodiments the phosphorus containing compound includes an alkyl phosphite that has a fully saturated alkyl group. In some embodiments the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments the phosphorus containing compound includes an alkyl phosphite, a phosphoric acid ester, an amine salt of a phosphoric acid ester, or any combination thereof. In some embodiments the phosphorus containing compound includes an alkyl phosphite, an ester thereof, or a combination thereof. In some embodiments the phosphorus containing compound includes an alkyl phosphite. In some embodiments the phosphorus containing compound includes an alkenyl phosphite, a phosphoric acid ester, an amine salt of a phosphoric acid ester, or any combination thereof. In some embodiments the phosphorus containing compound includes an alkenyl phosphite, an ester thereof, or a combination thereof. In some embodiments the phosphorus containing compound includes an alkenyl phosphite. In some embodiments the phosphorus containing compound includes dialkyl hydrogen phosphites. In some embodiments the phosphorus-containing compound is essentially free of, or even completely free of, phosphoric acid esters and/or amine salts thereof. In some embodiments the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment the phosphite may be sulfur-free i.e., the phosphite is not a thiophosphite. The phosphite having at least one hydrocarbyl group with 4 or more carbon atoms may be represented by the formulae:

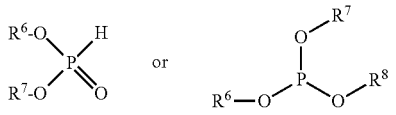

wherein at least one of $R^6$, $R^7$ and $R^8$ may be a hydrocarbyl group containing at least 4 carbon atoms and the other may be hydrogen or a hydrocarbyl group. In one embodiment $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups.

The alkyl groups may be linear or branched, typically linear, and saturated or unsaturated, typically saturated. Examples of alkyl groups for $R^6$, $R^7$ and $R^8$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments the fatty phosphite component the lubricant composition overall is essentially free of, or even completely free of phosphoric acid ester and/or amine salts thereof. In some embodiments the fatty phosphite comprises an alkenyl phosphite or esters thereof, for example esters of dimethyl hydrogen phosphite. The dimethyl hydrogen phosphite may be esterified, and in some embodiments transesterified, by reaction with an alcohol, for example oleyl alcohol.

The lubricant may also include one or more phosphorous amine salts. In certain embodiments the amount thereof will be such that the additive package, or in other embodiments the resulting industrial lubricant compositions, contains no more than 1.0 wt % of such materials, or even no more than 0.75 wt % or 0.6 wt %. In other embodiments the industrial lubricant additive packages, or the resulting industrial lubricant compositions, are essentially free of or even completely free of phosphorous amine salts.

The lubricant may also include one or more antiwear additives and/or extreme pressure agents, one or more rust and/or corrosion inhibitors, one or more foam inhibitors, one or more demulsifiers, or any combination thereof.

In some embodiments the industrial lubricant additive packages, or the resulting industrial lubricant compositions, are essentially free of or even completely free of phosphorous amine salts, dispersants, or both.

In some embodiments the industrial lubricant additive packages, or the resulting industrial lubricant compositions, include a demulsifier, a corrosion inhibitor, a friction modifier, or combination of two or more thereof. In some embodiments the corrosion inhibitor includes a tolyltriazole. In still other embodiments the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial lubricant additive package may be present in the overall industrial lubricant from 1 wt % to 5 wt %, or in other embodiments from 1 wt %, 1.5 wt %, or even 2 wt % up to 2 wt %, 3 wt %, 4 wt %, 5 wt %, 7 wt % or even 10 wt %. Amounts of the industrial gear additive package that may be present in the industrial gear concentrate lubricant are the corresponding amounts to the wt % above, where the values are considered without the oil present (i.e. they may be treated as wt % values along with the actual amount of oil present).

The lubricant may also include a derivative of a hydroxy-carboxylic acid. Suitable acids may include from 1 to 5 or 2 carboxy groups or from 1 to 5 or 2 hydroxy groups. In some embodiments the friction modifier may be derivable from a hydroxy-carboxylic acid represented by the formula:

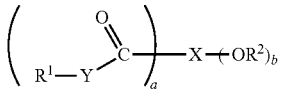

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N< formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment the hydroxy-carboxylic acid used in the preparation of the derivative of a hydroxy-carboxylic acid is represented by the formula:

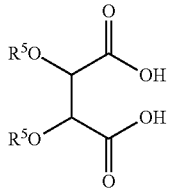

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid. In one embodiment the derivative of hydroxycarboxylic acid includes an imide, a di-ester, a di-amide, an imide amide, an imide ester or an ester-amide derivative of tartaric acid. In one embodiment the derivative of hydroxycarboxylic acid includes an ester derivative of tartaric acid. In one embodiment the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In other embodiments the alcohols are linear. In some embodiments, the alcohol and/or amine have at least 6 carbon atoms. Accordingly, certain embodiments the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides may be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

In some embodiments the additive package includes one or more corrosion inhibitors, one or more dispersants, one or more antiwear and/or extreme pressure additives, one or more extreme pressure agents, one or more antifoam agents, one or more detergents, and optionally some amount of base oil or similar solvent as a diluent.

The additional additives may be present in the overall industrial gear lubricant composition from 0.1 wt % to 30 wt %, or from a minimum level of 0.1 wt %, 1 wt % or even 2 wt % up to a maximum of 30 wt %, 20 wt %, 10 wt %, 5 wt %, or even 2 wt %, or from 0.1 wt % to 30 wt %, from 0.1 wt % to 20 wt %, from 1 wt % to 20 wt %, from 1 wt % to 10 wt %, from 1 wt % to 5 wt %, or even about 2 wt %. These ranges and limits may be applied to each individual additional additive present in the composition, or to all of the additional additives present.

The industrial gearbox lubricant may thus comprise:

0.01 wt % to 5 wt % of the phosphite ester of the disclosed technology, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulfonate (typically a neutral or slightly overbased calcium dinonyl naphthalene sulfonate), and 0.001 wt % to 2 wt %, or 0.01 wt % to 1 wt % of an antiwear agent (other than the phosphite ester of the present invention) chosen from zinc dialkyldithiophosphate, zinc dialkylphosphate, amine salt of a phosphorus acid or ester, or mixtures thereof.

The industrial gearbox lubricant may also comprise a formulation defined in the following table:

Industrial Gearbox Lubricant compositions

| | Embodiments (wt %) | | |
|---|---|---|---|
| Additive | A | B | C |
| Phosphite Ester of the invention | 0 to 5.0 | 0.01 to 3.0 | 0.005 to 1.0 |
| Sulfurized Olefin | 0 to 5.0 | 0.01 to 4.0 | 0.1 to 3 |
| Dispersant | 0 to 2.0 | 0.005 to 1.5 | 0.01 to 1.0 |
| Antifoam Agent | 0.001 to 0.012 | 0.001 to 0.004 | 0.001 to 0.003 |
| Demulsifier | 0.002 to 2 | .0025 to 0.5 | 0.005 to 0.04 |
| Metal Deactivator | 0.001 to 0.5 | 0.01 to 0.04 | 0.015 to 0.03 |
| Rust Inhibitor | 0.001 to 1.0 | 0.005 to 0.5 | 0.01 to 0.25 |
| Amine Phosphate | 0 to 3.0 | 0.005 to 2 | 0.01 to 1.0 |
| Oil of Lubricating Viscosity | Balance to 100% | Balance to 100% | Balance to 100% |

Specific examples of an industrial gearbox lubricant include those summarized in the following table:

Industrial Gearbox Lubricant compositions

| | Embodiments (wt %) | | |
|---|---|---|---|
| Additive | A | B | C |
| Phosphite Ester of the invention | 0 | 0.25 | 0.5 |
| Dispersant | 0.1 | 0.1 | 0.1 |
| Polyacrylate Antifoam Agent | 0.02 | 0.02 | 0.02 |
| Alkoxylated Demulsifier | 0.01 | 0.01 | 0.01 |
| Thiazole/Triazole Metal Deactivators | 0.035 | 0.035 | 0.035 |
| Fatty Amine Rust Inhibitor | 0.05 | 0.05 | 0.05 |
| Sulfurized Olefin | 1.0 | 1.0 | 1.0 |
| Oil of Lubricating Viscosity | Balance to 100% | Balance to 100% | Balance to 100% |

Antiwear performance of each lubricant may be evaluated in accordance with ASTM D2782-02(2008) Standard Test Method for Measurement of Extreme-Pressure Properties of Lubricating Fluids (Timken Method), ASTM D2783-03 (2009) Standard Test Method for Measurement of Extreme-Pressure Properties of Lubricating Fluids (Four-Ball Method), ASTM D4172-94(2010) Standard Test Method for Wear Preventive Characteristics of Lubricating Fluid (Four-Ball Method) and ASTM D5182-97(2014) Standard Test Method for Evaluating the Scuffing Load Capacity of Oils (FZG Visual Method).

EXAMPLES

The following examples provide illustrations of the invention. These examples are non-exhaustive and are not intended to limit the scope of the invention.

Products are prepared by reacting 1 mole of dimethylphosphite with 1 mole (total) (that is, relative molar amounts, i.e., mole ratio) of mixtures of diols as set forth in the table below. The following is an example of a specific synthesis: To a 3-L four-necked round bottom flask equipped with a nitrogen subsurface inlet tube, thermocouple, mechanical glass rod stirrer, and a Dean-Stark trap connected to a sequence of a Friedrichs cold water condenser and a isopropanol-dry ice cold finger, is added dimethyl hydrogen phosphite (660.3 g, 6 mol), 1,6-hexanediol (283.6 g, 2.4 mol) and 2-butyl-2-ethyl-1,3-propanediol (673.1 g, 3.6 mol). Sodium methoxide (anhydrous) (1.3 g, 0.024 mol, 0.4 mol %) is then added in one portion with stirring under nitrogen. The reaction is heated to 115° C. and held at this temperature for 2 hours. After that, it is held at 120° C. for an additional 6 hours, during which time methanol is removed by distillation. After cooling the reaction vessel to 90° C., the reaction is subjected to vacuum stripping under reduced pressure (1-7 Pa (1-5 mmHg)), removing additional methanol and other volatiles. The final product is a clear, slightly viscous liquid.

The materials are evaluated by gel permeation chromatography and the weight percent of the oligomeric species is reported. The weight percent of cyclic monomeric species is 100% minus the amount of the oligomeric species.

| Ex. | diol (i), mole % | diol (ii), mole % | weight percent oligomeric species. |
|---|---|---|---|
| 1* | 1,6-hexanediol, 0 | 2-butyl-2-ethyl-1,3-propanediol, 100 | 25 |
| 2 | ", 30 | ", 70 | 52 |
| 3 | ", 40 | ", 60 | 59 |

-continued

| Ex. | diol (i), mole % | diol (ii), mole % | weight percent oligomeric species. |
|---|---|---|---|
| 4 | ", 45 | ", 55 | 62 |
| 5 | ", 50 | ", 50 | 63 |
| 6 | ", 55 | ", 45 | 67 |
| 7 | ", 60 | ", 40 | 71 |
| 8 | ", 65 | ", 35 | 71 |
| 9* | ", 75 | ", 25 | 80 |
| 10* | ", 100 | ", 0 | 100 |
| 11 | ", 40 | 2-methyl-2-propyl-1,3-propanediol, 60 | — |
| 12 | 1,4-butanediol, 45 | ", 55 | — |
| 13 | ", 40 | 2-ethyl-1,3-hexane-diol, 60 | — |
| 14 | ", 50 | 2-propyl-1,3-propanediol, 50 | — |
| 15 | 1,5-pentanediol, 37 | 2-butyl-2-ethyl-1,3-propanediol, 63 | — |
| 16 | ", 40 | 2-ethyl-1,3-hexane-diol, 60 | — |
| 17 | ", 40 | 2-propyl-1,3-propanediol, 60 | — |

*A comparative or reference example.
— not determined
" the above chemical

Certain of the above products are formulated into lubricants characteristic of greases, hydraulic fluids, turbine oils, circulating oils, and industrial gearbox lubricants, and are tested to demonstrate suitability for the desired uses.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements.

What is claimed is:

1. A lubricant composition comprising an oil of lubricating viscosity and a phosphite ester composition (A), other than a zinc salt, which comprises the reaction product of (a) a monomeric phosphorous acid or an ester thereof with (b) at least two alkylene diols:

a first alkylene diol (i) having two hydroxy groups in a 1,4 or 1,5 or 1,6 relationship;

a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being about 5 to about 12;

wherein the relative molar amounts of monomeric phosphorous acid or ester thereof (a) and the total of the alkylene diols (b) are in a ratio of about 0.9:1.1 to about 1.1:0.9;

wherein the relative molar amounts of the first alkylene diol (i) and the alkyl-substituted 1,3-propylene diol (ii) are in a ratio of about 30:70 to about 65:35; and a grease thickener.

2. The lubricant composition of claim 1 wherein the amount of the phosphite ester composition is about 0.001 to about 10 weight percent of the lubricant composition.

3. The lubricant composition of claim 1 wherein monomeric phosphorous ester comprises dimethyl phosphite.

4. The lubricant composition of claim 1 wherein the first alkylene diol comprises 1,4-butanediol, 1,5-pentanediol, or 1,6-hexanediol.

5. The lubricant composition of claim 1 wherein the second alkylene diol comprises 2-ethyl-2-butylpropane-1,3-diol, 2-ethylhexane-1,3-diol, 2,2-dibutylpropane-1,3 -diol, or 2-methyl-2-propylpropane-1,3 -diol.

6. The lubricant composition of claim 1 wherein the phosphite ester composition comprises at least one oligomeric species comprising 3 to about 20 phosphorus atoms and at least one cyclic monomeric species comprising a single phosphorus atom.

7. The lubricant composition of claim 1 comprising a cyclic monomeric species comprising a single phosphorus atom and a chain of 3 carbon atoms derived from the second alkylene diol.

8. The lubricant composition of claim 6 wherein the relative amount of the cyclic monomeric species to the amount of the oligomeric species is about 1:3 to about 1:1 or about 1:3 to about 1:0.8 by weight.

9. The lubricant of claim 1, wherein the grease thickener is a metal salt of a carboxylic acid, or mixtures thereof.

10. The lubricant of claim 9, wherein the carboxylic acid is a fatty acid chosen from a mono-hydroxycarboxylic acid, a di-hydroxycarboxylic acid, a poly-hydroxycarboxylic acid or mixtures thereof.

11. The lubricant of claim 9, wherein the carboxylic acid is a hydroxy-substituted fatty acid or mixtures thereof.

12. The lubricant of claim 11, wherein the hydroxy-substituted fatty acid is 12-hydroxystearic acid.

13. The lubricant of claim claim 1 wherein the grease thickener is present at 0.1 wt % to 40 wt %, or 1 wt % to 20 wt % of the lubricant composition.

14. The lubricant of claim 1 wherein the composition is a lubricating grease, comprising:

(a) 0.001 wt % to 10 wt % of said phosphite ester composition;

(b) 1 wt % to 20 wt % of a grease thickener;

(c) 0 wt % to 5 wt % of an extreme pressure agent;

(d) 0 wt % to 10 wt % of other performance additives; and (e) balance of an oil of lubricating viscosity.

15. The lubricant of claim 1, wherein the composition is a lubricating grease, comprising:

(a) 0.002 wt % to 5.0 wt % of said phosphite ester composition;

(b) 1 wt % to 20 wt % of a grease thickener;

(c) 0.2 wt % to 1 wt % of an extreme pressure agent;

(d) 0.1 wt % to 10 wt % of other performance additives; and (e) balance of an oil of lubricating viscosity.

16. A method of lubricating a mechanical device with a grease, comprising supplying to the mechanical device the lubricant of claim 1.

17. A method of lubricating a hydraulic fluid system, a circulating oil system, a turbine system, or an industrial gearbox, comprising supplying thereto a lubricant comprising an oil of lubricating viscosity and a phosphite ester composition (A), other than a zinc salt, which comprises the reaction product of (a) a monomeric phosphorous acid or an ester thereof with (b) at least two alkylene diols:

a first alkylene diol (i) having two hydroxy groups in a 1,4 or 1,5 or 1,6 relationship;

a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being about 5 to about 12;

wherein the relative molar amounts of monomeric phosphorous acid or ester thereof (a) and the total of the alkylene diols (b) are in a ratio of about 0.9:1.1 to about 1.1:0.9;

wherein the relative molar amounts of the first alkylene diol (i) and the alkyl-substituted 1,3-propylene diol (ii) are in a ratio of about 30:70 to about 65:35.

18. The method of claim 17 wherein the amount of the phosphite ester composition is about 0.001 to about 10 weight percent of the lubricant composition.

19. The lubricant composition of claim 17 wherein monomeric phosphorous ester comprises dimethyl phosphite.

20. The method of claim 17 wherein the first alkylene diol comprises 1,4-butanediol, 1.5-pentanediol, or 1,6-hexanediol.

21. The method of claim 17 wherein the second alkylene diol comprises 2-ethyl-2-butylpropane-1,3 -diol, 2-ethylhexane-1,3 -diol, 2,2-dibutylpropane-1,3-diol, or 2-methyl-2-propylpropane-1,3-diol.

22. The method of claim 17 wherein the phosphite ester composition comprises at least one oligomeric species comprising 3 to about 20 phosphorus atoms and at least one cyclic monomeric species comprising a single phosphorus atom.

23. The method of claim 17 comprising a cyclic monomeric species comprising a single phosphorus atom and a chain of 3 carbon atoms derived from the second alkylene diol.

24. The method of claim 22 wherein the relative amount of the cyclic monomeric species to the amount of the oligomeric species is about 1:3 to about 1:1 or about 1:3 to about 1:0.8 by weight.

25. The method of claim 17, wherein the lubricant comprises:

0.001 wt % to 3 wt % of said phosphite ester composition, 0.0001 wt % to 0.15 wt % of a corrosion inhibitor chosen from 2,5-bis(tert-dodecyldithio)-1,3,4-thiadiazole, tolyltriazole, or mixtures thereof, 0.02 wt % to 3 wt % of antioxidant chosen from aminic or phenolic antioxidants, or mixtures thereof, 0.005 wt % to 1.5 wt % of a borated or a non-borated succinimide dispersant, 0.001 wt % to 1.5 wt % of a neutral of slightly overbased calcium naphthalene sulfonate 0.001 wt % to 2 wt % of an antiwear agent (other than the phosphite ester (A) chosen from zinc dialkyldithiophosphate, zinc dialkylphosphate, amine salt of a phosphorus acid or ester, or mixtures thereof.

26. The method of claim 17, wherein the lubricant comprises:

0.01 wt % to 1.5 wt % of said phosphite ester composition, 0.0001 wt % to 0.1 wt % of a corrosion inhibitor chosen from 2,5-bis(tert-dodecyldithio)-1,3,4-thiadiazole, tolyltriazole, or mixtures thereof, an oil of lubricating viscosity, 0.01 wt % to 1.5 wt % of antioxidant chosen from aminic or phenolic antioxidants, or mixtures thereof, 0.01 wt % to 2 wt % of a borated or a non-borated succinimide dispersant, 0.001 wt % to 1.5 wt % of a neutral of slightly overbased calcium naphthalene sulfonate, 0.001 to 1 wt % of a carboxylic acid or anhydride chosen from polyisobutylene succinic acid or anhydride, or dodecenyl succinic acid, 0.05 wt % to 1.5 wt % of an antiwear agent (other than the phosphite ester (A) chosen from zinc dialkyldithiophosphate, zinc dialkylphosphate, amine salt of a phosphorus acid or ester, or mixtures thereof.

27. The method lubricant of claim 17 wherein the lubricant comprises:

0.01 wt % to 5 wt % of said phosphite ester composition, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulfonate, and 0.001 wt % to 2 wt % of an antiwear agent (other than the phosphite ester (A) ) chosen from zinc dialkyldithiophosphate, zinc dialkylphosphate, amine salt of a phosphorus acid or ester, or mixtures thereof.

* * * * *